US007146723B2

(12) United States Patent
Schmitt et al.

(10) Patent No.: US 7,146,723 B2
(45) Date of Patent: Dec. 12, 2006

(54) METHOD OF IMPROVING CONNECTION OF CONTACTS

(75) Inventors: Hans-Michael Schmitt, Muennerstadt (DE); Klaus Hemmert, Mittelstreu (DE); Bernhard Knuettel, Bad Neustadt (DE); Oswald Reuss, Unterelsbach (DE); Annegret Suckfuell, Mittelstreu (DE)

(73) Assignee: Preh-Werke GmbH & Co. KG, Bad Neustadt a.d. Saale (DE)

( * ) Notice: Subject to any disclaimer, the term of this patent is extended or adjusted under 35 U.S.C. 154(b) by 82 days.

(21) Appl. No.: 10/609,527

(22) Filed: Jul. 1, 2003

(65) Prior Publication Data

US 2004/0003936 A1 Jan. 8, 2004

(30) Foreign Application Priority Data

Jul. 1, 2002 (DE) ..... 102 29 525

(51) Int. Cl.
*H01R 43/02* (2006.01)

(52) U.S. Cl. ..... 29/860; 29/825; 29/857; 219/243

(58) Field of Classification Search ..... 29/825, 29/857, 860; 219/243
See application file for complete search history.

(56) References Cited

U.S. PATENT DOCUMENTS 6,217,397 B1 * 4/2001 Brammer ..... 439/874

FOREIGN PATENT DOCUMENTS

| | | |
|---|---|---|
| DE | 32 29 899 A1 | 2/1984 |
| DE | 199 34 158 A1 | 2/2001 |
| DE | 101 04 083 A1 | 11/2001 |
| WO | WO 86/06882 A1 | 11/1986 |

* cited by examiner

*Primary Examiner*—Carl J. Arbes
(74) *Attorney, Agent, or Firm*—McGrath, Geissler, Olds & Richardson, PLLC

(57) ABSTRACT

The mechanical connection of contacts through induction soldering is improved. To which end, a plastic dome is produced through preliminary encapsulation by injection molding of at least one contact and subsequent final encapsulation, where the two contact geometries to be joined can, for example, be premated. With an appropriate solder preform, the plug-in connection can be secured through induction soldering by enclosing this dome. The appropriate tool is then placed over the plastic dome, by which the heat generated melts the solder preform and securely joins the two contacts to one another.

13 Claims, 3 Drawing Sheets

METHOD OF IMPROVING CONNECTION OF CONTACTS

This nonprovisional application claims priority under 35 U.S.C. § 119(a) on Patent Application No. 102 29 525.5 filed in Germany on Jul. 1, 2002, which is herein incorporated by reference.

BACKGROUND OF THE INVENTION

1. Field of the Invention

The present invention relates to a device and method for improving the connection of assembled contacts or contacts that are pre-assembled in, for example, blind assembly.

2. Description of the Background Art

It is well known that components assembled in manufacturing processes, for example, blind assembly have the disadvantage that plug-in connections, in particular, which become inaccessible through this type of assembly, fail when they are stressed primarily through shaking or vibratory motions or corrosion. The mechanical stability of the contact closure provided by the assembly of the prior art is thus not adequate.

DE 101 04 083 A1 discloses a modular unit having a proximity switch and a cable connector. FIG. 1 shows a schematic illustration of the modular unit of the prior art. Referring to FIG. 1, there is shown the proximity switch 101, which has an outer casing 103 and an insulating part 104 fastened to a front side of the outer casing 103. The insulating part 104 has a connector element 105 leading outwards to receptacles 106. The cable connector 102 consists of a cable 107 and a joining part 108, in which the cable is fastened. The cable 107 has cable wires 109 therein, which connect electrically to the receptacles. An electrical connection is made between a stripped and tinned end of the cable wires 109 and the receptacles 106 of the connector by induction soldering. In order to perform this induction soldering, a coil, for conducting heat, is pushed over the transition between the insulating part 104 and the connecting part 108 after the proximity switch 101 and cable connector 102 are joined together, so that when the coil conducts current the receptacles 106 are heated together with the inserted conductor ends and the solder provided therein.

Because the coil must reach around the cable, a solution of this type, however, is not usable for contacts joined together in certain automated manufacturing processes, for example, in blind assembly. Additionally, as one skilled in the art would appreciate, in order for the coil to reach around the modular unit a certain spacing, e.g., the width of the cable, must be provided in a cable direction of the coil, whereby a uniform and complete heating of the solder within the modular unit is not achieved thereby diminishing the contact stability.

SUMMARY OF THE INVENTION

It is therefore an object of the present invention to specify a method by which the mechanical contact force between the contacts can be increased despite inaccessibility.

The invention is based on the concept of improving the mechanical connection of the contacts through induction soldering. Preliminary encapsulation by injection molding of at least one of the contacts and subsequent final encapsulation molding produces a plastic dome in which the two contact geometries that are to be joined can, for example, be premated. With an appropriate solder preform, the plug-in connection can be secured through induction soldering by enclosing this dome. The appropriate tool is then placed over the plastic dome, by which the heat generated melts the solder and securely joins the two contacts to one another.

This solution makes possible a simple and lasting improvement of the mechanical connection of contacts that are no longer accessible, for example, pre-assembled contacts. As such, it is no longer necessary to screw together the two parts with the contacts. Another great advantage is that the undermining of contacts by corrosion can no longer occur. The invention is explained in detail with an example embodiment and drawing.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawings, which are given by way of illustration only, and thus, are not limitive of the present invention, and wherein.

DETAILED DESCRIPTION

Figure 1:
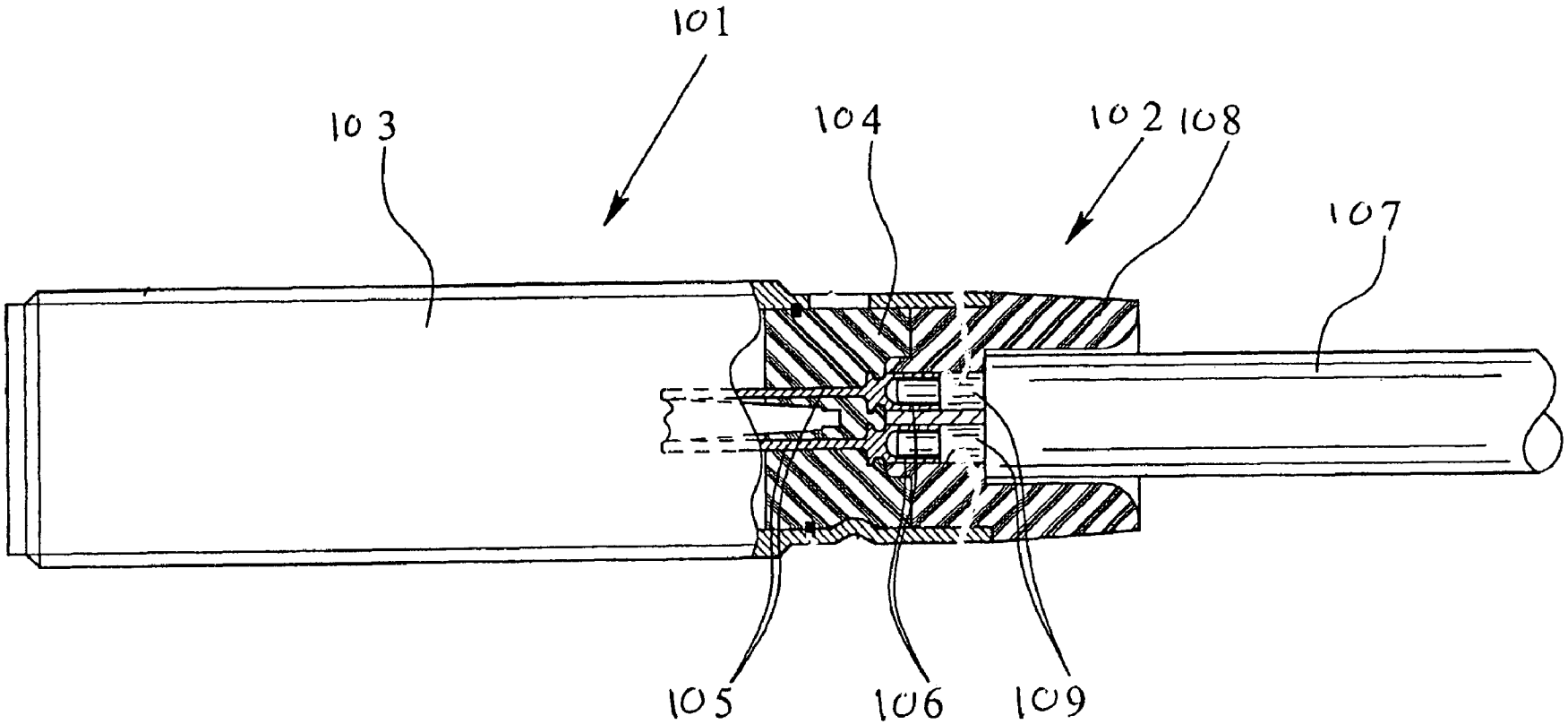
Fig. 1 (Prior Art)
FIG. 1 shows an illustration of a connector assembly according to the prior art.
Figure 2:
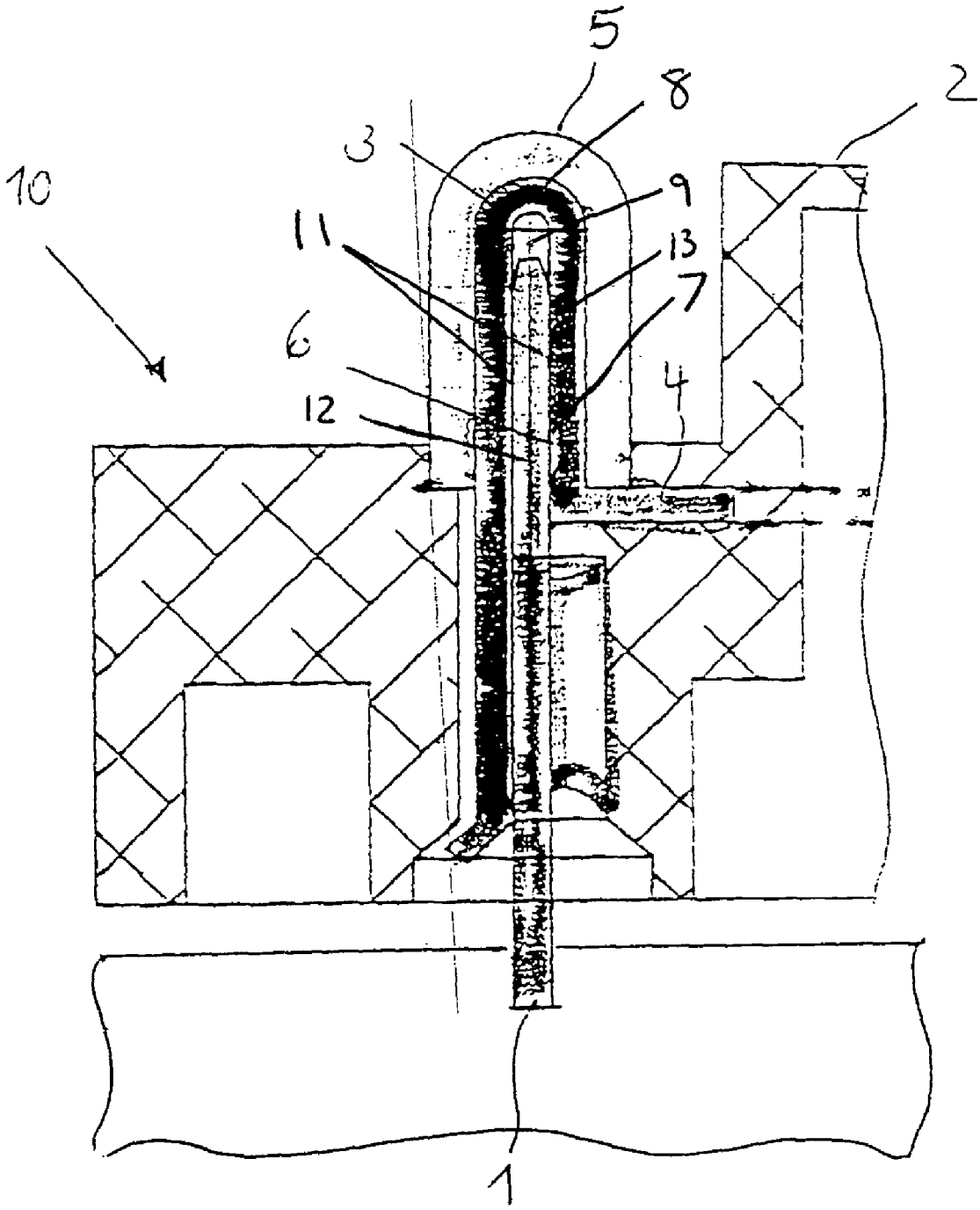
FIG. 2 shows a connector assembly according to a preferred embodiment of the present invention.

FIG. 2 shows a closed system 10 (connector assembly) including a first contact, e.g., a servomotor contact 1 (blade) of a servomotor (not shown), and a plastic cover 2. The blade 1 of the servomotor engages in a second contact, e.g., a drawn spring contact 3, which may be formed with a contact loop 4, that may extend substantially perpendicular from a spring contact portion 13, and are retained or molded inside the plastic cover 2.

In other words, the spring contact 3, as shown in FIG. 2, has a portion thereof bent at an upper area 8 forming an aperture 9 such that the blade 1 is affixed therein. Additionally, because of the looped structure of the spring contact 3, the side faces 11 of the spring contact 3, which are adjacent to the aperture 9, provide additional securing forces onto the blade 1 to thereby fixedly contain the blade 1 within the aperture 9 of the spring contact 3. Further, because the contact loop 4, which extends substantially perpendicular from the spring contact portion 13, is retained within the plastic cover 2, the spring contact 3 is fixedly held within the plastic cover 2 such that the spring contact 3 is prevented from undesirably rotating about an axis 12.

A plastic dome 5 is then formed over the drawn spring contact 3, which encompasses an upper portion of the spring contact 3. The spring contact 3 and the blade 1 may be made of a conductive material, e.g., they may be metallic.

Upon assembly of the two parts, i.e. placement of the plastic cover 2 on the servomotor, which is not shown in detail, both the servomotor contact 1 and the spring contact 3 become inaccessible from outside. This prevents the servomotor contact 1 and the spring contact 3 from being subjected to external elements such as corrosion, thereby prolonging the durability and life-span of the connector assembly 10.

To improve the mechanical connection, a solder preform 6, for example tin, silver or gold, is liquefied by induction soldering on the surface of the servomotor contact 1 and the spring contact 3, at least, for example, in a side region 7. For this purpose, an induction tool (not shown) is placed over the plastic dome 5. The heat that is generated is calibrated so as to avoid melting or destroying the plastic dome 5. The two contacts 1, 3 are securely joined to one another by the tin 6. As such, both the mechanical and electrical connections are thereby improved.

Figure 3:
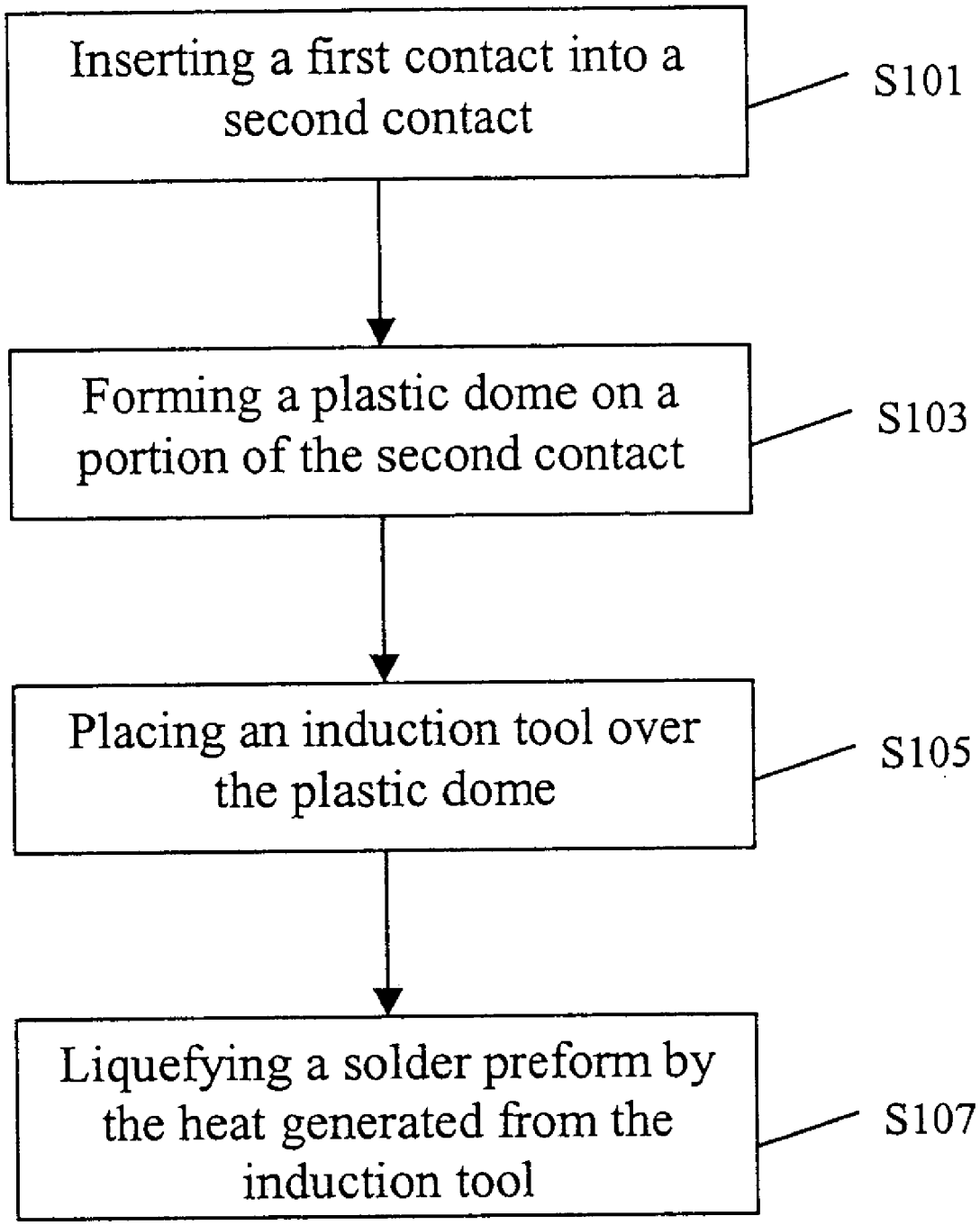
FIG. 3 is a flowchart outlining the steps for assembling the connector assembly of FIG. 2, according to a preferred embodiment of the present invention.

FIG. 3 is a flowchart outlining the steps for assembling the connector assembly of FIG. 2. The first contact 1 is engaged into the second contact 3 in step S101, by inserting the first contact 1 into the aperture 9 formed by the second contact 3, which is retained in the plastic cover 2 and has the solder preform 6 on at least a portion thereof.

In step S103, the plastic dome 5 is formed over a portion of the spring contact 3, which includes the upper area 8, such that plastic dome 5 extends towards the plastic cover 2. Alternatively, the plastic dome 5 can be formed over the second contact 3 prior to the insertion of the first contact 1 into the second contact 3.

Next, in step S105, an induction tool is placed over the plastic dome 5, which may substantially encompass the plastic dome 5, to thereby generate a sufficient amount of heat that does not deform the plastic dome 5.

Then, in step S107, the solder preform 6 is liquefied by the heat generated by the induction tool, to thereby fixedly form a connection between the first contact 1 and the second contact 3 such that the first contact 1 is fixedly secured to the second contact 3 and to provide an improved electrical connection between the first and second contact 1,3.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for producing a secure connection in contact geometries assembled in blind assembly, wherein a plastic dome is formed on at least one of the contact geometries by encapsulation molding with plastic, and is surrounded by an induction soldering tool such that an appropriate solder preform between the contact geometries is liquefied by the induction soldering.

2. A method for assembling a connector assembly comprising:

inserting a first contact into an aperture formed by a second contact, the aperture being formed by the second contact being bent about an upper area;

forming a plastic dome over a portion of the second contact;

placing an induction tool over the plastic dome; and liquefying a solder perform, which is formed on a portion of the second contact, by heat generated from the induction tool.

3. The method according to claim 2, wherein the first contact and the second contact are made of a conductive metal.

4. The method according to claim 2, wherein the second contact is fixedly held within a plastic cover.

5. The method according to claim 4, wherein the plastic dome is formed such that the plastic dome extends towards the plastic cover thereby encompassing the portion of the second contact containing the solder perform.

6. The method according to claim 2, wherein the induction tool substantially encompasses the plastic dome.

7. The method according to claim 2, wherein the connector assembly is formed in blind assembly.

8. The method according to claim 4, wherein the second contact further includes a contact loop extending substantially perpendicular within the plastic cover from a spring contact portion.

9. The method according to claim 2, wherein side faces of the second contact, which are adjacent to the aperture, fixedly secure the first contact in the aperture.

10. The method according to claim 2, wherein the solder perform is provided on a side region of the second contact.

11. The method according to claim 10, wherein the side region is adjacent to the aperture formed by the second contact.

12. The method according to claim 4, wherein the plastic dome substantially encompasses a portion of the second contact that is not retained within the plastic cover.

13. The method according to claim 2, wherein the plastic dome conducts heat generated by the induction tool.

* * * * *